US011443708B2

(12) United States Patent
Ishihara et al.

(10) Patent No.: US 11,443,708 B2
(45) Date of Patent: Sep. 13, 2022

(54) LIQUID CRYSTAL DISPLAY DEVICE AND DISPLAY SYSTEM

(71) Applicant: Japan Display Inc., Tokyo (JP)

(72) Inventors: Tomoyuki Ishihara, Tokyo (JP); Kazuhiko Sako, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/342,783

(22) Filed: Jun. 9, 2021

(65) Prior Publication Data

US 2021/0390919 A1 Dec. 16, 2021

(30) Foreign Application Priority Data

Jun. 10, 2020 (JP) ..... JP2020-101275

(51) Int. Cl.
*G09G 3/36* (2006.01)

(52) U.S. Cl.
CPC ..... *G09G 3/3614* (2013.01); *G09G 2310/08* (2013.01); *G09G 2320/0247* (2013.01); *G09G 2320/0252* (2013.01); *G09G 2330/021* (2013.01)

(58) Field of Classification Search
CPC ..... G09G 3/3614; G09G 2310/08; G09G 2320/0247; G09G 2320/0252; G09G 2330/021; G09G 2340/0435
See application file for complete search history.

(56) References Cited

U.S. PATENT DOCUMENTS

| | | | | |
|---|---|---|---|---|
| 8,139,012 | B2 * | 3/2012 | Fukui | G09G 3/3614 345/96 |
| 9,984,644 | B2 * | 5/2018 | Yamazaki | G09G 3/3696 |
| 2007/0001963 | A1 * | 1/2007 | Koma | G09G 3/3614 345/96 |
| 2007/0252803 | A1 * | 11/2007 | Fukui | G09G 3/3614 345/96 |
| 2014/0015819 | A1 * | 1/2014 | Yamazaki | G09G 3/3655 345/209 |
| 2014/0043315 | A1 * | 2/2014 | Yamazaki | G09G 3/3696 345/212 |
| 2018/0254015 | A1 * | 9/2018 | Suyama | G09G 3/3614 |
| 2019/0108804 | A1 | 4/2019 | Sasaki et al. | |

FOREIGN PATENT DOCUMENTS

| | | |
|---|---|---|
| JP | 2014149322 A | 8/2014 |
| WO | 2017164100 A1 | 9/2017 |

* cited by examiner

*Primary Examiner* — Michael J Jansen, II
(74) *Attorney, Agent, or Firm* — K&L Gates LLP

(57) ABSTRACT

A liquid crystal display device includes: a liquid crystal panel having pixels with a first electrode and a second electrode; a control circuit; and a counter. The number and an arrangement of pixels where a potential of the second electrode is higher than that of the first electrode in a first mode equal the number and an arrangement of pixels where the potential of the first electrode is higher than that of the second electrode in a second mode. The counter increases a count while the panel operates in the first mode, and decreases the count while the panel operates in the second mode. The control circuit operates the panel in the first mode when the count at a determination timing is not greater than a first threshold, and operates the panel in the second mode when the count at the determination timing is not less than a second threshold.

6 Claims, 5 Drawing Sheets

LIQUID CRYSTAL DISPLAY DEVICE AND DISPLAY SYSTEM

CROSS-REFERENCE TO RELATED APPLICATION

This application claims the benefit of priority from Japanese Patent Application No. 2020-101275 filed on Jun. 10, 2020, the entire contents of which are incorporated herein by reference.

BACKGROUND

1. Technical Field

What is disclosed herein relates to a liquid crystal display device and a display system.

2. Description of the Related Art

In liquid crystal display devices, the orientation of liquid crystals is controlled by the potential difference between two electrodes. It is known that problems with liquid crystals occur when what is called direct current drive, in which the potential of two electrodes is constant, is performed thereon. For example, the liquid crystals are continuously affected by the current flowing in a fixed direction, whereby they may be deteriorated, and pixels may be visually recognized as if pixel burn-in has occurred. Thus, in a general liquid crystal display device, inversion drive is performed in which the potentials of two electrodes are switched in accordance with the update cycle of a frame image (for example, Japanese Patent Application Laid-open Publication No. 2014-149322 and WO 2017/164100).

As one form of liquid crystal display devices, a liquid crystal display device capable of using a dynamic frame rate method has been known. The dynamic frame rate method is a method that allows a frame image not to be updated at a fixed cycle. As a specific method, the Adaptive-Sync standard standardized by Video Electronics Standards Association (VESA) has been known, for example. When the inversion drive is simply applied to such a dynamic frame rate method, the time in which the liquid crystal display device is operated with a potential of one of the two electrodes higher than that of the other one and the time in which the liquid crystal display device is operated with the potential of the other one higher than that of the one electrode becomes unequal, because frame images are not updated at a fixed cycle. Thus, when the switching in the inversion drive is repeated multiple times, the drive time in which the current in one of the two directions is applied to the liquid crystals by the inversion drive may become longer than the drive time in which the current in the other direction is applied thereto. Such an imbalance in the drive time may make it difficult to hamper deterioration such as burn-in.

For the foregoing reasons, there is a need for a liquid crystal display device and a display system capable of more reliably hampering deterioration.

SUMMARY

According to an aspect, a liquid crystal display device includes: a liquid crystal panel provided with a plurality of pixels; a control circuit configured to control an operation of the liquid crystal panel; and a counter configured to increase and decrease a count value with an elapse of time. Each of the pixels is provided with a first electrode and a second electrode. The liquid crystal panel is configured to be switched between a first mode and a second mode. The number of pixels and an arrangement of pixels in which a potential of the second electrode is set to be higher than a potential of the first electrode in the first mode are the same as the number of pixels and an arrangement of pixels in which the potential of the first electrode is set to be higher than the potential of the second electrode in the second mode. The counter starts counting in accordance with a supply timing of a first vertical synchronization signal among a plurality of vertical synchronization signals supplied from outside multiple times, gradually increases the count value while the liquid crystal panel is operated in the first mode, and gradually decreases the count value while the liquid crystal panel is operated in the second mode. The control circuit sets a determination timing in accordance with the supply timing of a latest vertical synchronization signal, operates the liquid crystal panel in the first mode when the count value at the determination timing is equal to or less than a first threshold, and operates the liquid crystal panel in the second mode when the count value at the determination timing is equal to or greater than a second threshold that is greater than the first threshold.

DETAILED DESCRIPTION

Figure 1:
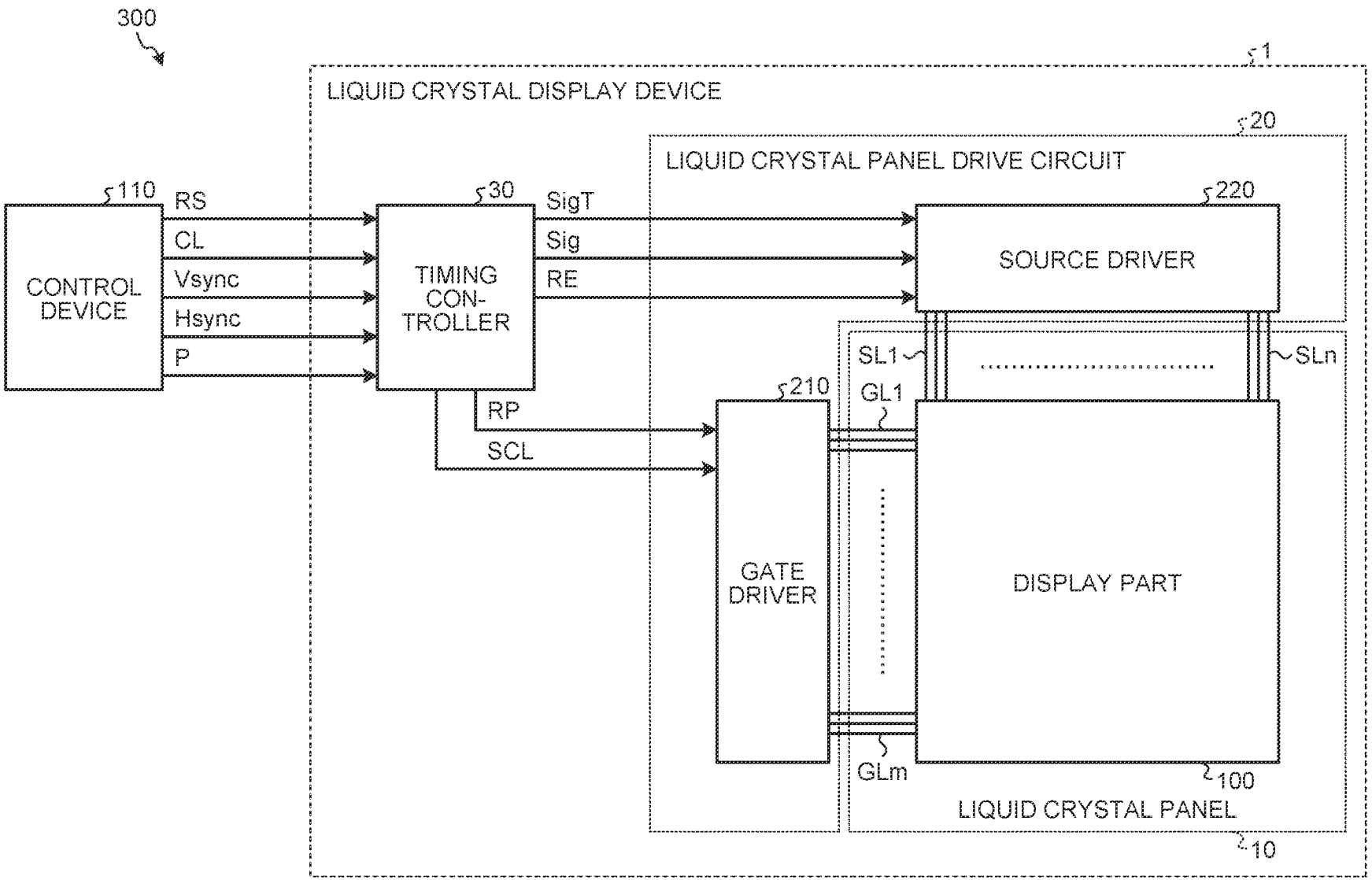
FIG. 1 is a diagram illustrating an example of a main configuration of a display system according to an embodiment.

Hereinafter, embodiments of the present disclosure will be described with reference to the accompanying drawings. What is disclosed herein is merely an example, and the present disclosure naturally encompasses an appropriate modification maintaining the gist of the disclosure that is easily conceivable by those skilled in the art. To further clarify the description, the widths, the thicknesses, the shapes, and the like of components may be schematically illustrated in the drawings as compared with actual forms. However, they are merely an example and do not limit the interpretation of the present disclosure. In the present specification and the drawings, the same element as that described in the drawing that has already been described is denoted by the same reference numeral, and detailed description thereof may be omitted in some cases as appropriate.

In this disclosure, when an element is described as being "on" another element, the element can be directly on the other element, or there can be one or more elements between the element and the other element.

FIG. 1 is a diagram illustrating an example of a main configuration of a display system 300 according to an embodiment. The display system 300 includes a liquid crystal display device 1 and a control device 110. The liquid crystal display device 1 includes a liquid crystal panel 10, a liquid crystal panel drive circuit 20, and a timing controller 30. The liquid crystal panel 10 includes a display part 100 provided with a plurality of pixels Pix (see FIG. 2).

Figure 2:
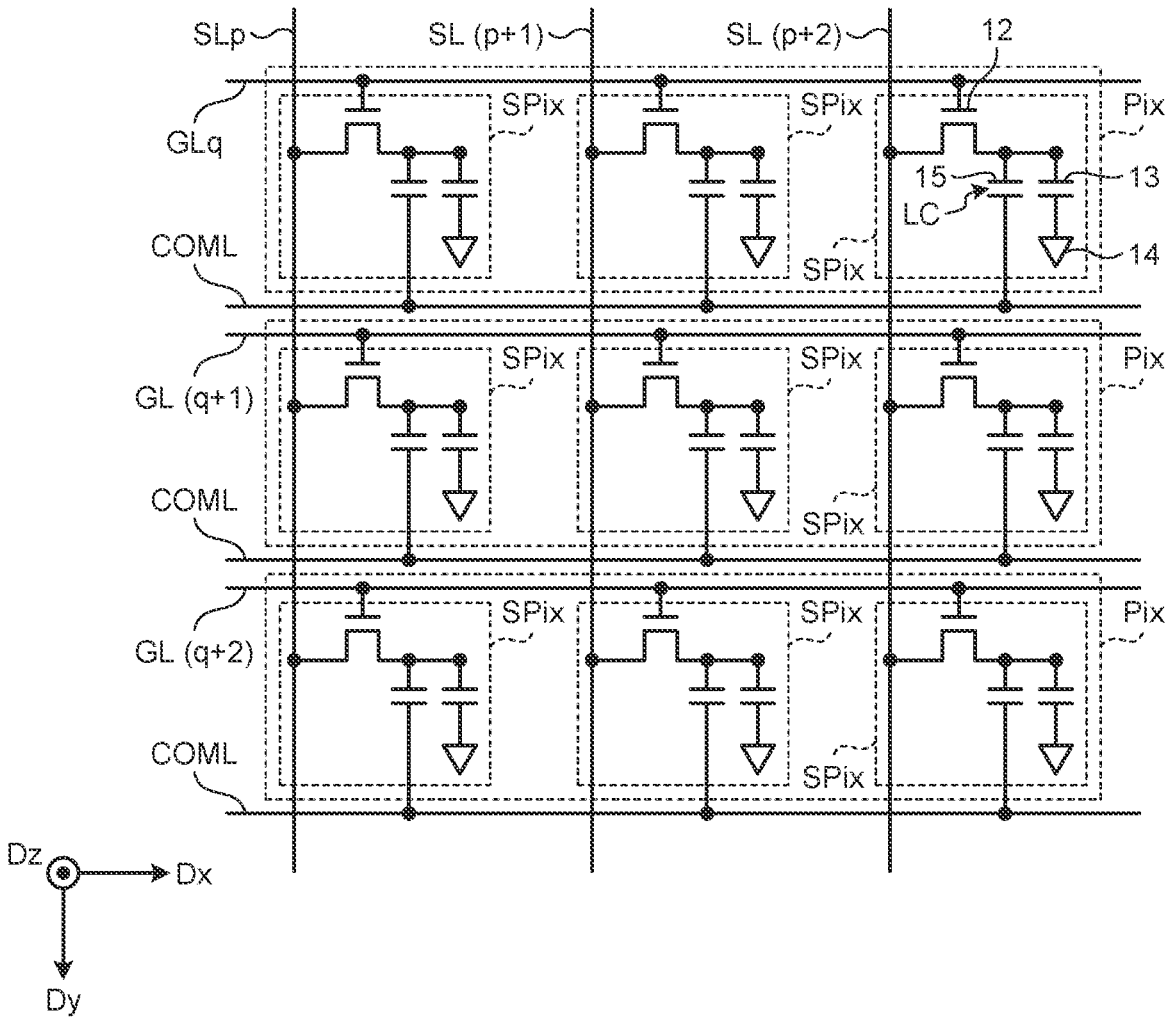
FIG. 2 is a diagram illustrating an example of pixels and sub-pixels provided in a display part.

FIG. 2 is a diagram illustrating an example of pixels Pix and sub-pixels SPix provided in the display part 100. Each of the pixels Pix includes a plurality of sub-pixels SPix. Hereinafter, an arrangement direction of the sub-pixels SPix included in one pixel Pix is referred to as a first direction Dx. A direction along the plate surface of the display part 100 and orthogonal to the first direction Dx is referred to as a second direction Dy. A direction orthogonal to the first direction Dx and the second direction Dy is referred to as a third direction Dz.

For example, the sub-pixels SPix are arranged in a matrix (row-column configuration). Each of the sub-pixels SPix includes a switching element 12, a capacitor 13, a pixel electrode 15, and the like. The gate of the switching element 12 is coupled to a scanning line GL. One of the source and the drain of the switching element 12 is coupled to a signal line SL, and the other is coupled to the capacitor 13.

As illustrated in FIG. 1, m scanning lines such as scanning lines GL1, GL2, . . . GLm are provided in the display part 100. Hereinafter, the term "scanning line GL" is a comprehensive expression of each of the scanning lines GL1, GL2, . . . , and GLm. m is a natural number of three or more. In FIG. 2, among the m scanning lines GL, three scanning lines GL of scanning lines GLq, GL(q+1), and GL(q+2), and the sub-pixels SPix coupled to the three scanning lines GL are illustrated. q is a natural number within a range of 1 to (m−2). As illustrated in FIG. 1, n signal lines such as signal lines SL1, SL2, . . . SLn are provided in the display part 100. Hereinafter, the term "signal line SL" is a comprehensive expression of each of the signal lines SL1, SL2, . . . , and SLn. n is a natural number of three or more. In FIG. 2, among the n signal lines SL, three signal lines SL of signal lines SLp, SL(p+1), and SL(p+2), and the sub-pixels Spix coupled to the three signal lines SL are illustrated. p is a natural number within a range of 1 to (n−2).

The signal line SL transmits a pixel signal Sig, which will be described later. The scanning line GL transmits a drive signal. The switching element 12 allows for communication between the source and the drain in accordance with the timing at which the drive signal is supplied to the gate. The capacitor 13 accumulates charge corresponding to the pixel signal Sig transmitted via the signal line SL and the switching element 12. The charge of the capacitor 13 is reset in accordance with the application timing of a write row initialization signal RP, which will be described later. For example, a reset potential is a potential of a reference potential supply part 14 coupled to the capacitor 13.

The pixel electrode 15 is an electrode individually provided in each sub-pixel Spix. The potential of the pixel electrode 15 corresponds to the charge of the capacitor 13 accumulated corresponding to the pixel signal Sig. Common electrodes COML each of which is shared among more than one sub-pixel Spix are provided in the display part 100. The display part 100 also includes two light-transmissive substrates stacked so as to face each other in the third direction Dz, and a liquid crystal layer LC sealed between the two light-transmissive substrates. The orientation of the liquid crystals included in the liquid crystal layer LC at the position of each sub-pixel Spix in plan view in the first direction Dx and the second direction Dy is made to be an orientation corresponding to the potential difference between the pixel electrode 15 and the common electrode COML, thereby setting the transmissivity (gradation) of each sub-pixel Spix. That is, the gradation corresponds to the pixel signal Sig. In the embodiment, each of the pixel electrodes 15 functions as a first electrode. In the embodiment, each of the common electrodes COML functions as a second electrode. The pixel electrodes 15 are provided on one of the two light-transmissive substrates. The common electrodes COML are provided on one or the other of the two light-transmissive substrates. When the pixel electrodes 15 are provided on one of the two light-transmissive substrates, and the common electrodes COML are provided on the other of the two light-transmissive substrates, the pixel electrodes 15 and the common electrodes COML face each other with the liquid crystal layer LC interposed therebetween.

The direction of the current generated by the potentials of the pixel electrode 15 and the common electrode COML can be switched in accordance with a second instruction signal RE (see FIG. 4 and FIG. 5), which will be described later. In the embodiment, for example, a frame inversion driving method is employed as the inversion driving method for switching the direction of the current generated by the potentials. In the frame inversion driving method, a first mode in which the potential applied to the pixel electrode 15 in each sub-pixel Spix is set to be higher than the potential of the common electrode COML, and a second mode in which the potential applied to the pixel electrode 15 in each sub-pixel Spix is set to be lower than the potential of the common electrode COML, are provided such that the two modes can be switched from one to the other. The frame period is a period during which one frame image is displayed. The frame image in the embodiment is, for example, an image to be displayed on the entire "image display region", which will be described later. The direction of the current generated by the potentials of the pixel electrode 15 and the common electrode COML may be switched by switching the relative relation (whether a high potential or a low potential) of a potential of one of the common electrode COML and the pixel electrode 15 to a potential of the other thereof or by changing both the potential of the pixel electrode 15 and the potential of the common electrode COML.

As illustrated in FIG. 2, each pixel Pix includes more than one sub-pixel Spix. The sub-pixels Spix included in one pixel Pix are provided with color filters in different colors. The color filters are provided on one of the two light-transmissive substrates described above. The one light-transmissive substrate is a light-transmissive substrate on one surface side (display surface side) on which an image is displayed. The color combination of the color filters in the sub-pixels Spix included in one pixel Pix is red (R), green (G), and blue (B), for example. However, the color combination is not limited thereto and may be changed as appropriate. The number of sub-pixels Spix included in one pixel Pix may be two or less or four or more. The liquid crystal panel 10 may be what is called a monochrome liquid crystal panel. In such a case, each of the sub-pixels Spix individually functions as the pixel Pix. The arrangement direction of the sub-pixels Spix included in one pixel Pix is not limited to the first direction Dx as illustrated in FIG. 2, and may be the second direction Dy or may be in a matrix (row-column configuration) (for example, 2×2). The arrangement of the pixels Pix and the sub-pixels Spix is not limited to a matrix (row-column configuration), and for example, the pixels Pix and the sub-pixels Spix may be alternately arranged in a zigzag manner. The display part 100 provided with the pixels Pix functions as an "image display region".

The liquid crystal panel 10 according to the embodiment is a liquid crystal panel supporting a dynamic frame rate method. For example, the liquid crystal panel 10 according to the embodiment is a transmissive liquid crystal panel or a transflective liquid crystal panel. Each sub-pixel Spix individually controls the transmissivity of light from a back light unit, which is not illustrated, provided on the opposite side of the display surface side (rear surface side), whereby the liquid crystal panel 10 displays an image. In this case, the pixel electrode 15 and the common electrode COML are formed using a light-transmissive compound such as indium tin oxide (ITO). The liquid crystal panel 10 may also be a reflective liquid crystal panel. In such a case, a front light unit that emits light from the display surface side may be provided instead of the back light unit, or the front light unit may be omitted on the assumption that external light from the display surface side is used. In such a case, the pixel electrode 15 is a reflective electrode that reflects light.

The liquid crystal panel drive circuit 20 supplies various signals for controlling the operation of each sub-pixel Spix to the liquid crystal panel 10, under the control of the timing controller 30. The liquid crystal panel drive circuit 20 includes a gate driver 210 and a source driver 220. The gate driver 210 is coupled to the liquid crystal panel 10 via the scanning lines GL1, GL2, . . . , and GLm. The gate driver 210 supplies a drive signal to the scanning line GL. The gate driver 210 is a circuit including a shift register, which is not illustrated, and switches, by the operation of the shift register, the scanning line GL to be supplied with the drive signal in a predetermined sequence. For example, the predetermined sequence is a sequence in which the scanning line GL positioned at one end side in the second direction Dy is supplied with the drive signal first, and the scanning line GL to be supplied with the drive signal is shifted toward the other end side one by one in accordance with the operation of the shift register. However, the sequence is not limited thereto and may be changed as appropriate. Hereinafter, the term "first scanning line GL" refers to the scanning line GL to which the drive signal is supplied first.

The source driver 220 is coupled to the liquid crystal panel 10 via the signal lines SL1, SL2, . . . , and SLn. The source driver 220 supplies the pixel signals Sig supplied from the timing controller 30 to the signal lines SL line by line. Here, the sub-pixels Spix that are arranged in the first direction Dx and share one scanning line GL with one another, are referred to as a pixel row (line). The line-by-line supply of the pixel signals Sig means that the pixel signals Sig individually supplied to the respective sub-pixels Spix included in one line are supplied to the signal lines SL at the same timing. The switching timing of the scanning line GL to be supplied with the drive signal and the switching timing of the pixel signal Sig are controlled in a synchronous manner, and thus the pixel signals Sig supplied to the sub-pixels Spix arranged in the second direction Dy are individually controlled. The pixel signals Sig supplied to the sub-pixels Spix included in one line are individually controlled by individually supplying the pixel signals Sig to the signal lines SL.

The timing controller 30 is interposed between the control device 110 and the liquid crystal panel drive circuit 20 and supplies signals (output signals) to the liquid crystal panel drive circuit 20 in accordance with signals (input signals) supplied from the control device 110. For example, the input signals include a reset signal RS, a clock signal CL, a vertical synchronization signal Vsync, a horizontal synchronization signal Hsync, and an image signal P. For example, the output signals include the pixel signal Sig, a source timing signal SigT, the second instruction signal RE, the write row initialization signal RP, and a write row shift clock signal SCL. The timing controller 30 supplies the pixel signal Sig, the source timing signal SigT, and the second instruction signal RE to the gate driver 210. The timing controller 30 also supplies the write row initialization signal RP and the write row shift clock signal SCL to the source driver 220.

The reset signal RS is a signal for resetting the state of the liquid crystal display device 1 to the initial state. The reset signal RS is input at the start of operation of the liquid crystal display device 1. The clock signal CL is a periodic signal for controlling the operations of the components in a synchronous manner. The synchronization control timing of the signals other than the clock signal CL is determined on the basis of the timing of the clock signal CL. The vertical synchronization signal Vsync is a signal for controlling the switching timing of a frame image. The vertical synchronization signal Vsync is supplied in accordance with the switching timing of the frame image. The horizontal synchronization signal Hsync is a signal for controlling the timing to switch the scanning line GL to be supplied with the drive signal among the scanning lines GL arranged in the second direction Dy. The number of times that the horizontal synchronization signal Hsync is supplied during the display period of one frame image corresponds to the number (m) of scanning lines GL. The image signal P is a signal corresponding to the frame image to be displayed on the liquid crystal display device 1. The image signal P functions as an input image for the liquid crystal display device 1.

The pixel signal Sig is a signal supplied to each sub-pixel Spix on the basis of the image signal P. The source timing signal SigT is a signal for controlling the supply timing of the pixel signal Sig. The supply timing of the source timing signal SigT to the source driver 220 synchronizes with the supply timing of the write row initialization signal RP and the write row shift clock signal SCL to the gate driver 210. The source driver 220 supplies the pixel signals Sig to the signal lines SL line by line in accordance with the supply timing of the source timing signal SigT. The second instruction signal RE is a signal for switching and controlling the direction of the current generated by a signal supplied to each sub-pixel Spix serving as the pixel signal Sig and the potential of the common electrode COML. The write row initialization signal RP is a signal for initializing the operating state of the shift register of the gate driver 210. When the operating state of the shift register is initialized, the "first scanning line GL" is set as the scanning line GL to which the drive signal is supplied. The write row shift clock signal SCL is a signal for shifting the scanning line GL to which the drive signal is supplied one by one. The number of times that the write row shift clock signal SCL is supplied corresponds to the number (m) of scanning lines GL.

The control device 110 supplies an input image to the liquid crystal display device 1 and supplies various control signals relating to the display of the input image. Here, the supply of the input image means the supply of the image signal P from the control device 110 to the timing controller 30. The various control signals refer to the reset signal RS, the clock signal CL, the vertical synchronization signal Vsync, and the horizontal synchronization signal Hsync.

For example, the control device 110 is an information processing device that includes an arithmetic unit, a storage, an image output part, and the like, which are not illustrated. The control device 110 functions as a host for the liquid crystal display device 1 in the display system 300. Image data corresponding to the image signal P is stored in the storage. The image output part includes a circuit that outputs various control signals, which are described above, in accordance with the output of the image signal P.

Figure 3:
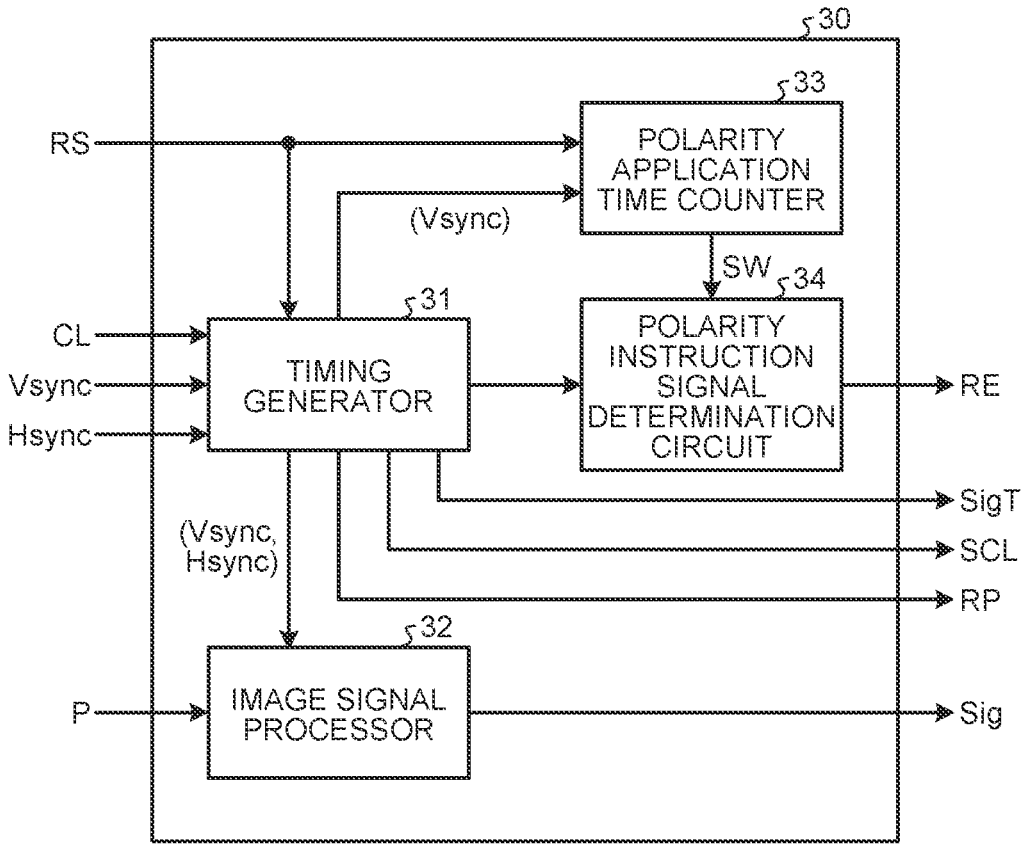
FIG. 3 is a block diagram illustrating an example of a functional configuration of a timing controller.

Hereinafter, a more specific configuration of the timing controller 30 will be described with reference to FIG. 3. FIG. 3 is a block diagram illustrating an example of a functional configuration of the timing controller 30. The timing controller 30 includes a timing generator 31, an image signal processor 32, a polarity application time counter 33, and a polarity instruction signal determination circuit 34. The reset signal RS is supplied to the timing generator 31 and the polarity application time counter 33. The clock signal CL, the vertical synchronization signal Vsync, and the horizontal synchronization signal Hsync are supplied to the timing generator 31. The image signal P is supplied to the image signal processor 32.

The timing controller 30 is a circuit implemented to function as the timing generator 31, the image signal processor 32, the polarity application time counter 33, and the polarity instruction signal determination circuit 34. More specifically, the timing controller 30 is provided as one of an application specific integrated circuit (ASIC), a field programmable gate array (FPGA), and another dedicated integrated circuit (IC), for example.

The timing generator 31 synchronizes the operation timings of the polarity application time counter 33, the polarity instruction signal determination circuit 34, and the image signal processor 32. The timing generator 31 also outputs the source timing signal SigT, the write row shift clock signal SCL, and the write row initialization signal RP so as to synchronize with the operation timings. More specifically, the timing generator 31 supplies a first control signal to the polarity application time counter 33 in accordance with the timing at which the vertical synchronization signal Vsync is supplied. The first control signal may be the vertical synchronization signal Vsync or may be a signal generated by the timing generator 31 in accordance with the vertical synchronization signal Vsync. The polarity application time counter 33 supplies second control signals to the image signal processor 32 in accordance with the timing at which the vertical synchronization signal Vsync is supplied. The second control signals may be the vertical synchronization signal Vsync and the horizontal synchronization signal Hsync, or may be signals generated by the timing generator 31 in accordance with the vertical synchronization signal Vsync and the horizontal synchronization signal Hsync. The timing generator 31 also controls the output timing of the write row initialization signal RP in accordance with the timing at which the vertical synchronization signal Vsync is supplied. The timing generator 31 also controls the output timing of the source timing signal SigT and the write row shift clock signal SCL in accordance with the timing at which the horizontal synchronization signal Hsync is supplied.

The image signal processor 32 generates the pixel signal Sig on the basis of the image signal P. More specifically, for example, the image signal P is a signal corresponding to a frame image having the number of pixels and the arrangement of pixels corresponding to the number of pixels Pix and the arrangement of the pixels Pix arranged in the display part 100. The image signal processor 32 generates a signal corresponding to a gradation value for each sub-pixel Spix included in each pixel Pix as the pixel signal Sig so that the display corresponding to the image signal P is performed on the display part 100. More specifically, when the image signal P is a signal corresponding to RGB image data, the image signal processor 32 generates the pixel signal Sig as a signal for applying potentials corresponding to the gradation values of red (R), green (G), and blue (B) in each pixel indicated by the RGB image data to each sub-pixel Spix. When the number of pixels and the arrangement of pixels of the input image are different from the number of the pixels Pix and the arrangement of the pixels Pix arranged in the display part 100, the image signal processor 32 performs a conversion process to cause the display part 100 to perform display corresponding to the input image while taking into account the difference.

The image signal processor 32 controls the supply timing of the pixel signals Sig in accordance with the second control signals. More specifically, in accordance with the vertical synchronization signal Vsync, the image signal processor 32 controls the line-by-line supply timing of the pixel signals Sig to the sub-pixels Spix coupled to the above-described scanning line GL to which the drive signal is supplied first. The image signal processor 32 also controls the line-by-line switching timing of the pixel signal Sig in accordance with the switching of the scanning line GL (line) to which the drive signal is supplied, in accordance with the horizontal synchronization signal Hsync.

The polarity application time counter 33 performs counting on the basis of the first control signal. A relation between the counting and various signals relating to the operations of the liquid crystal display device 1 will now be described with reference to FIG. 4. Hereinafter, the term "count value" refers to a value managed by the counting. For example, the count value in the embodiment is a real number that may take either a positive or negative value.

Figure 4:
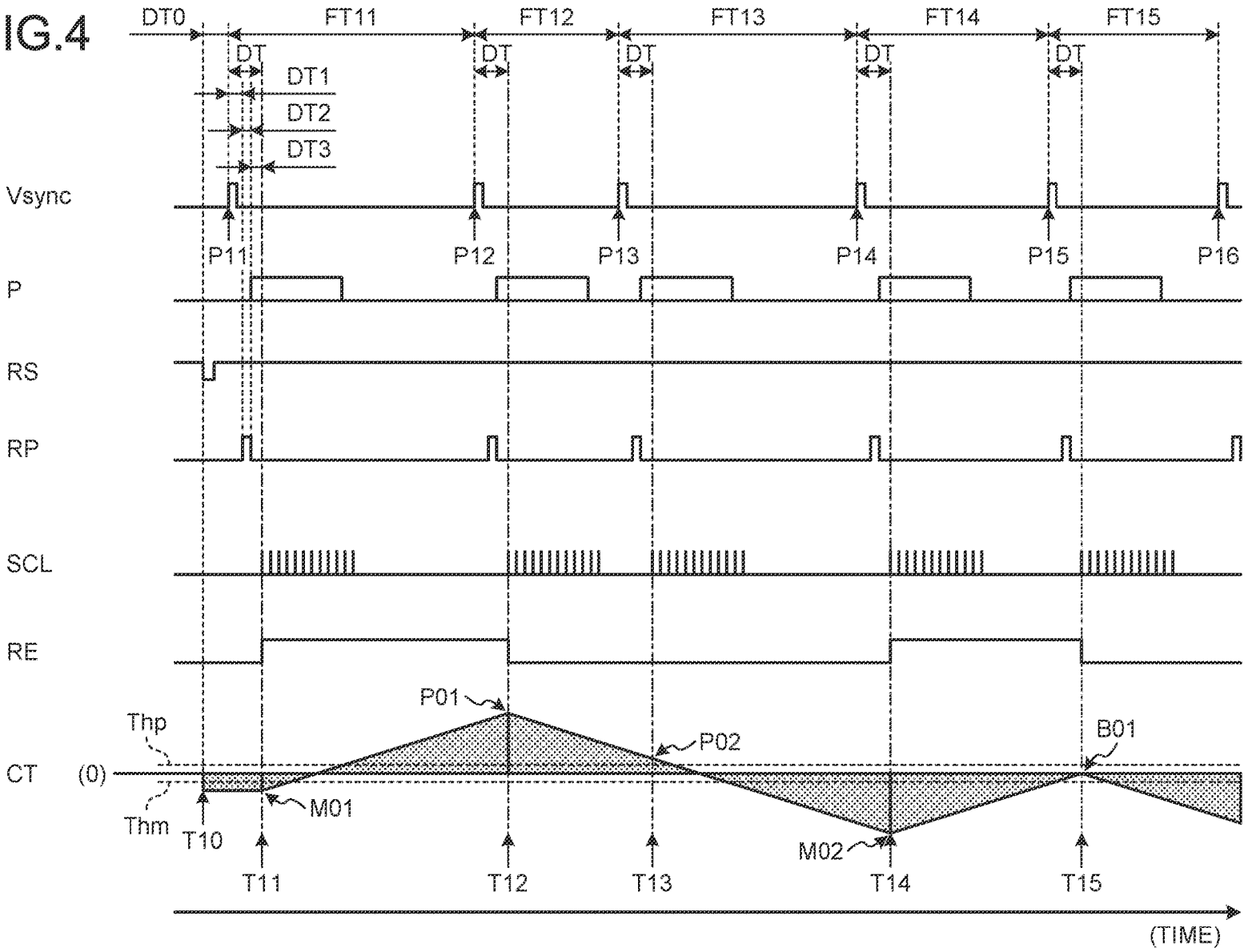
FIG. 4 is a time chart illustrating an example of inversion drive control in a case where the time lengths of frame periods are not fixed.
Figure 5:
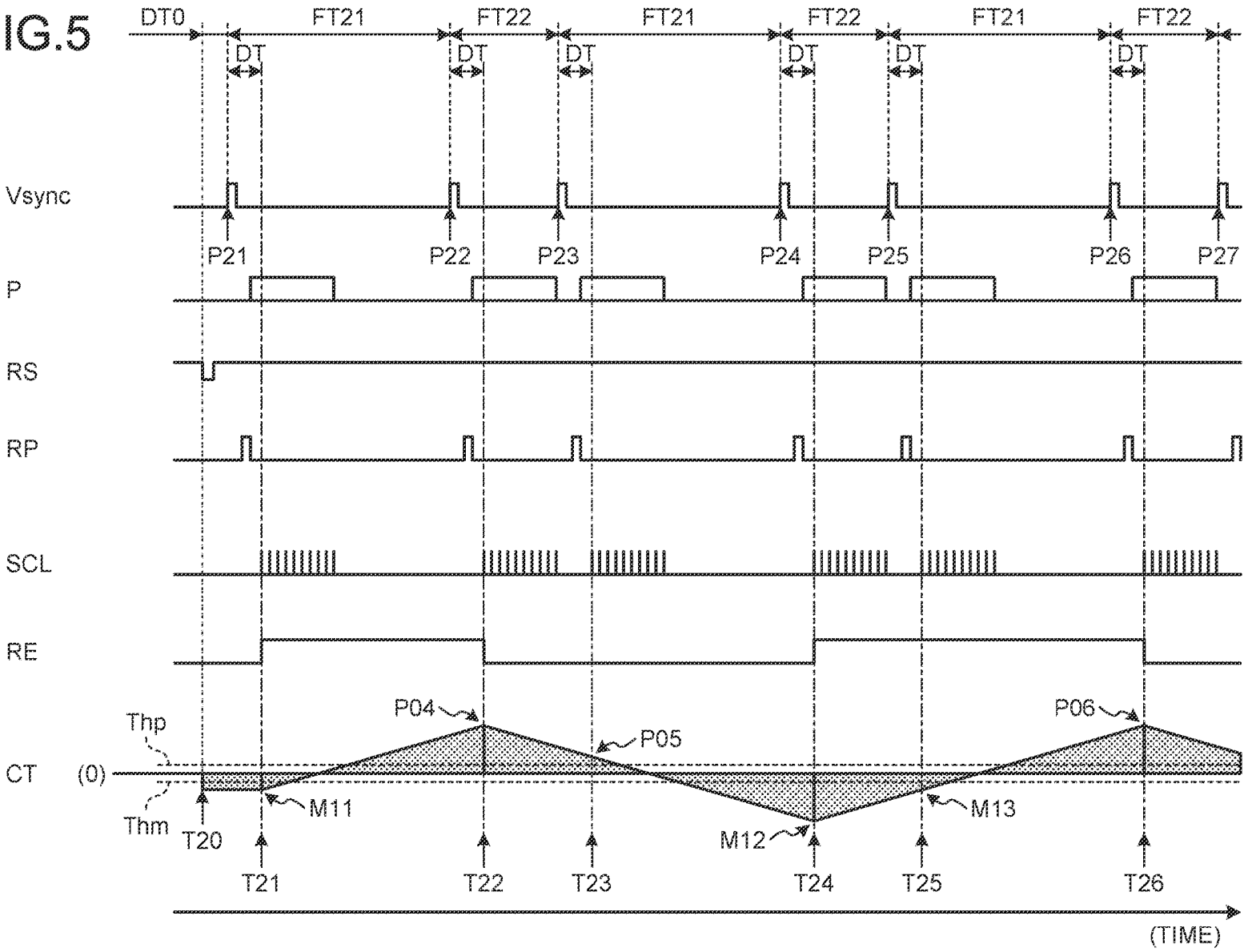
FIG. 5 is a time chart illustrating an example of inversion drive control in a case where the lengths of frame periods included in two frame periods that are periodically repeated are different from each other.

FIG. 4 is a time chart illustrating an example of inversion drive control in a case where the time lengths of frame periods are not fixed. In FIG. 4 and FIG. 5, which will be described later, a relation between a counter CT indicating the time-series changes of the count value and the supply timing of the other signals is illustrated. The term "FIG. 4 and the other figure" refers to FIG. 4 and FIG. 5.

First, the polarity application time counter 33 sets the count value to an initial value in accordance with the timing at which the reset signal RS is supplied. The initial value is a value less than a first threshold Thm or a value greater than a second threshold Thp. The first threshold Thm is less than a predetermined count value. The second threshold Thp is greater than the predetermined count value. That is, the second threshold Thp is greater than the first threshold Thm. The predetermined count value is 0 (zero), for example. In FIG. 4 and the other figure, the initial value is a value less than the first threshold Thm. The first threshold Thm and the second threshold Thp are values set in advance and that are recorded in the polarity application time counter 33.

When a first predetermined time DT0 passes after the reset signal RS is supplied, the vertical synchronization signal Vsync is supplied. The first predetermined time DT0 is an extremely short period of less than 1/60 (seconds), for example, but may be any time.

When a second predetermined time DT passes after the vertical synchronization signal Vsync is supplied, the gradations of the sub-pixels SPix are sequentially updated. During the second predetermined time DT, the supply of the write row initialization signal RP, the start of the supply of the image signal P corresponding to one frame image, the supply of the pixel signals Sig corresponding to the image signal P, and the start of the supply of the write row shift clock signal SCL for supplying the pixel signal Sig to each sub-pixel SPix line by line are sequentially performed. In FIG. 4 and the other figure, illustration of the supply of the pixel signals Sig is omitted. However, in reality, the pixel signals Sig are supplied at the timing corresponding to the write row shift clock signal SCL.

In FIG. 4, a supply timing P11 of the vertical synchronization signal Vsync that is supplied first after the reset signal RS is supplied, is the start timing of the earliest second predetermined time DT. The second predetermined time DT includes an elapsed time DT1 from the supply timing of a vertical synchronization signal Vsync to the following supply timing of a write row initialization signal RP, an elapsed time DT2 from the supply timing of the write row initialization signal RP to the following supply start timing of an image signal P, and an elapsed time DT3 from the supply start timing of the image signal P to the supply start timing of a write row shift clock signal SCL.

The vertical synchronization signal Vsync is sequentially supplied in accordance with the switching timing of the frame image. FIG. 4 illustrates supply timings P11, P12, P13, P14, and P15 of a plurality of the vertical synchronization signals Vsync to be sequentially supplied. The gradation of each of the sub-pixels SPix is sequentially updated by the pixel signals Sig generated corresponding to the image signal P for each of frame periods FT11, FT12, FT13, FT14, and FT15, after the second predetermined time DT passes from each of the supply timings P11, P12, P13, P14, and P15. A supply timing P16 of the vertical synchronization signal Vsync is the supply timing of the vertical synchronization signal Vsync that is supplied when a frame period (not illustrated) right after the frame period FT15 is started. The supply timing P16 is illustrated in order to indicate the end timing of the frame period FT15 started from the supply timing P15.

The time length of the elapsed time DT1, the time length of the elapsed time DT2, and the time length of the elapsed time DT3 are the same in each second predetermined time DT, although they are illustrated only in the earliest second predetermined time DT in the figure. That is, the time length of each second predetermined time DT is the same. The second predetermined time DT is an extremely short period of less than 1/240 (seconds), for example, but may be any time. Some or all of the time length of the elapsed time DT1, the time length of the elapsed time DT2, and the time length of the elapsed time DT3 may be different, or may be the same.

In the embodiment, the time lengths of a plurality of the frame periods are not uniform. The time lengths of the frame periods FT11, FT12, FT13, FT14, and FT15 illustrated in FIG. 4 are different from one another. The frame periods are not uniform such as above because the times required for the control device 110 to output the image signals P corresponding to the frame images are not fixed. For example, the start timing of a frame period (for example, the frame period FT13) during which the image signal P corresponding to a frame image that can be generated in a relatively short process is output, can relatively shorten the elapsed time from the start timing of the immediately preceding frame period. On the other hand, the start timing of a frame period (for example, the frame period FT12) during which the image signal P corresponding to a frame image that requires a relatively long process to generate is output, relatively extends the elapsed time from the start timing of the immediately preceding frame period. The frame periods are not uniform due to the correspondence between such a processing time and the elapsed time from the start timing of the immediately preceding frame period. In other words, the length of each frame period corresponds to the processing time required for generating a frame image to be displayed in the next frame period, and the processing performance of the control device 110 that generates the frame image.

The polarity application time counter 33 determines the direction of the current generated by the potentials of the pixel electrode 15 and the common electrode COML, on the basis of the count value at the "predetermined timing" set in advance for each frame period. When the frame inversion driving method is employed as in the embodiment, the polarity application time counter 33 performs a mode determination. The mode determination refers to a determination as to whether to operate the liquid crystal panel 10 in a first mode or a second mode. The polarity application time counter 33 outputs a first instruction signal SW in accordance with the result of the mode determination to the polarity instruction signal determination circuit 34. The "predetermined timing" is a timing at which the second predetermined time DT passes after the vertical synchronization signal Vsync is supplied in each frame period, as indicated by timings T11, T12, T13, T14, and T15 illustrated in FIG. 4, for example.

For example, a count value M01 at the timing T11 in the frame period FT11 is not changed from the initial value of the count value, and is less than the first threshold Thm. In this manner, when the count value at the "predetermined timing" is less than the first threshold Thm, the polarity application time counter 33 operates the liquid crystal panel 10 in the first mode. The polarity application time counter 33 outputs the first instruction signal SW for instructing the liquid crystal panel 10 to operate in the first mode. Consequently, the liquid crystal panel 10 is operated in the first mode after the timing T11.

The polarity application time counter 33 increases and decreases the count value in accordance with the direction of the current generated by the potentials of the pixel electrode 15 and the common electrode COML. More specifically, while the liquid crystal panel 10 is operated in the first mode, the polarity application time counter 33 gradually increases the count value. While the liquid crystal panel 10 is operated in the second mode, the polarity application time counter 33 gradually decreases the count value. The degree of gradual increase of the count value with the elapsed time and the degree of gradual decrease of the count value with the elapsed time are set in advance. In the embodiment, when the time operated in the first mode and the time operated in the second mode are equal to each other, the gradual increase of the count value due to the operation in the first mode and the gradual decrease of the count value due to the operation in the second mode are in the relation of cancelling out each other. In this case, the count value becomes ±0.

The first threshold Thm and the second threshold Thp may correspond to the degree of gradual increase of the count value and the degree of gradual decrease of the count value. For example, in a case where the count value is gradually increased or gradually decreased by $\alpha$ per $1/\beta$ seconds, the first threshold Thm and the second threshold Thp may be set within a range in which the absolute value with respect to zero becomes less than $\alpha$. For example, $\beta$ corresponds to the lower limit ($\beta$[Hz]) of the frame rate with which the liquid crystal panel 10 supporting the dynamic frame rate method can be driven.

In FIG. 4, the liquid crystal panel 10 is operated in the first mode after the timing T11 as described above. Thus, the polarity application time counter 33 gradually increases the count value. In FIG. 4, the count value M01 is less than the first threshold Thm at the timing T11. However, the count value is gradually increased from the timing T11 to the timing T12 and becomes a count value P01 greater than the second threshold Thp.

Hereinafter, processing performed by the polarity application time counter 33 along the time series will be described with reference to FIG. 4. Because the timing T12 in the frame period FT12 is the "predetermined timing", the polarity application time counter 33 performs the mode determination. Here, the count value P01 at the timing T12 is greater than the second threshold Thp. In this manner, when the count value at the "predetermined timing" is greater than the second threshold Thp, the polarity application time counter 33 operates the liquid crystal panel 10 in the second mode from the supply timing of the write row shift clock signal SCL after the timing T12. The polarity application time counter 33 outputs the first instruction signal SW for instructing the liquid crystal panel 10 to operate in the second mode. Consequently, the liquid crystal panel 10 is operated in the second mode after the timing T12. That is, the operation mode of the liquid crystal panel 10, which has been operated in the first mode from the timing T11 to the timing T12, is switched to the second mode at the timing T12.

As described above, the liquid crystal panel 10 is operated in the second mode after the timing T12. Thus, the polarity application time counter 33 gradually decreases the count value. In FIG. 4, the count value is gradually decreased from the count value P01 at the timing T12 to a count value P02 at the timing T13, but the count value P02 is still greater than the second threshold Thp.

Because the timing T13 in the frame period FT13 is the "predetermined timing", the polarity application time counter 33 performs the mode determination. Here, the count value P02 at the timing T13 is greater than the second threshold Thp. Thus, the polarity application time counter 33 continuously operates the liquid crystal panel 10 in the second mode. The polarity application time counter 33 outputs the first instruction signal SW for instructing the liquid crystal panel 10 to operate in the second mode. Consequently, the liquid crystal panel 10 continues to operate in the second mode after the timing T13.

As described above, the liquid crystal panel 10 continues to operate in the second mode after the timing T13. Thus, the polarity application time counter 33 gradually decreases the count value. In FIG. 4, the count value is gradually decreased from the count value P02 at the timing T13 to a count value M02 at the timing T14. The count value M02 becomes less than the first threshold Thm before reaching the timing T14.

Because the timing T14 in the frame period FT14 is the "predetermined timing", the polarity application time counter 33 performs the mode determination. Here, the count value M02 at the timing T14 is less than the first threshold Thm. Thus, the polarity application time counter 33 operates the liquid crystal panel 10 in the first mode from the supply timing of the write row shift clock signal SCL after the timing T14. The polarity application time counter 33 outputs the first instruction signal SW for instructing the liquid crystal panel 10 to operate in the first mode. Consequently, the liquid crystal panel 10 is operated in the first mode after the timing T14. That is, the operation mode of the liquid crystal panel 10, which has been operated in the second mode from the timing T12 to the timing T14, is switched to the first mode at the timing T14.

As described above, the liquid crystal panel 10 is operated in the first mode after the timing T14. Thus, the polarity application time counter 33 gradually increases the count value. In FIG. 4, because the count value M02 is less than the first threshold Thm at the timing T14, the count value is gradually increased from the timing T14 to a count value B01 at the timing T15. The count value B01 at the timing T15 is a value between the first threshold Thm and the second threshold Thp.

Because the timing T15 in the frame period FT15 is the "predetermined timing", the polarity application time counter 33 performs the mode determination. Here, the count value B01 at the timing T15 is a value between the first threshold Thm and the second threshold Thp. In this manner, when the count value at the "predetermined timing" is a value between the first threshold Thm and the second threshold Thp, the polarity application time counter 33 operates the liquid crystal panel 10 in a mode different from the operation mode before the "predetermined timing", from the supply timing of the write row shift clock signal SCL after the timing T15. In this case, because the liquid crystal panel 10 is operated in the first mode until the timing T15, the polarity application time counter 33 outputs the first instruction signal SW for instructing the liquid crystal panel 10 to operate in the second mode. Consequently, the liquid crystal panel 10 operates in the second mode after the timing T15. That is, the operation mode of the liquid crystal panel 10, which has been operated in the first mode from the timing T14 to the timing T15, is switched to the second mode at the timing T15. If the operation mode before the "predetermined timing" is the second mode, the operation mode after the "predetermined timing" is the first mode.

The polarity instruction signal determination circuit 34 controls the second instruction signal RE in accordance with the first instruction signal SW. In the example illustrated in FIG. 4, the second instruction signal RE is controlled to take one of the two values of high (H) and low (L). In the embodiment, when the second instruction signal RE is high (H), the source driver 220 controls the potential of each pixel signal Sig such that the liquid crystal panel 10 is operated in the first mode. When the second instruction signal RE is low (L), the source driver 220 controls the potential of each pixel signal Sig such that the liquid crystal panel 10 is operated in the second mode. The source driver 220 may also control both the potentials of the pixel signals Sig and the potentials of the common electrodes COML. The relation between the first mode and the second mode and the relation between high (H) and low (L) may be reversed. In such a case, high (H) and low (L) of the second instruction signal RE illustrated in FIG. 4 and FIG. 5 are reversed. In the embodiment, the pixel electrodes in the first mode are on the high (H) side and the pixel electrodes in the second mode are on the low (L) side. However, this may be reversed.

As illustrated in FIG. 4, even if the time lengths of the frame periods are not uniform, it is possible to hamper the occurrence of an imbalance between the operation time in the first mode and the operation time in the second mode.

In FIG. 4 and FIG. 5, the vertical synchronization signal Vsync, the write row initialization signal RP, and the write row shift clock signal SCL shift from low (L) to high (H) in accordance with their supply timings, and the reset signal RS shifts from high (H) to low (L) in accordance with its supply timing. However, such a relation between high (H) and low (L) is merely an example and is not limited to the example. The relations between high (H) and low (L) thereof may be partially or completely reversed.

In FIG. 3, an output from the timing generator 31 toward the polarity instruction signal determination circuit 34 is illustrated. However, this is not essential. For example, the output is an output of a timing control signal output from the timing generator 31 for controlling the update timing of the second instruction signal RE in accordance with the output of the first instruction signal SW from the polarity application time counter 33. With such a timing control signal, the update timing of the second instruction signal RE can be set more reliably to the timing synchronized with the "predetermined timing" such as the timings T11, T12, T13, T14, T15, and . . . .

The change pattern of the frame periods is not limited to the pattern in which the frame periods differ from one another as illustrated in FIG. 4.

FIG. 5 is a time chart illustrating an example of inversion drive control in a case where the lengths of frame periods included in two frame periods that are periodically repeated are different from each other. FIG. 5 illustrates a pattern in which a frame period F21 having a first time length and a frame period F22 having a second time length are alternately repeated. The first time length and the second time length are time lengths set in advance. The first time length is longer than the second time length. The example illustrated in FIG. 5 is the same as the example illustrated in FIG. 4 other than the difference in the frame periods.

Hereinafter, processing performed by the polarity application time counter 33 along the time series will be described with reference to FIG. 5. As described with reference to FIG. 4, the polarity application time counter 33 sets the count value to an initial value in accordance with the timing at which the reset signal RS is supplied. A count value M11 at a timing T21 in a frame period FT21 is not changed from the initial value of the count value and is less than the first threshold Thm. Thus, the polarity application time counter 33 operates the liquid crystal panel 10 in the first mode. The polarity application time counter 33 outputs the first instruction signal SW for instructing the liquid crystal panel 10 to operate in the first mode. Consequently, the liquid crystal panel 10 is operated in the first mode after the timing T21.

The liquid crystal panel 10 is operated in the first mode after the timing T21. Thus, the polarity application time counter 33 gradually increases the count value. In FIG. 5, because the count value M11 is less than the first threshold Thm at the timing T21, the count value is gradually increased from the timing T21 to a timing T22 and becomes a count value P04 that is greater than the second threshold Thp at the timing T22.

Because the timing T22 in a frame period FT22 is the "predetermined timing", the polarity application time counter 33 performs the mode determination. Here, the count value P04 at the timing T22 is greater than the second threshold Thp. Thus, the polarity application time counter 33 operates the liquid crystal panel 10 in the second mode. The polarity application time counter 33 outputs the first instruction signal SW for instructing the liquid crystal panel 10 to operate in the second mode from the supply timing of the write row shift clock signal SCL after the timing T22. Consequently, the liquid crystal panel 10 is operated in the second mode after the timing T22. That is, the operation mode of the liquid crystal panel 10, which has been operated in the first mode from the timing T21 to the timing T22, is switched to the second mode at the timing T22.

As described above, the liquid crystal panel 10 is operated in the second mode after the timing T22. Thus, the polarity application time counter 33 gradually decreases the count value. In FIG. 5, although the count value is gradually decreased from the count value P04 at the timing T22 to a count value P05 at a timing T23, the count value P05 is still greater than the second threshold Thp.

Because the timing T23 in the frame period FT21 is the "predetermined timing", the polarity application time counter 33 performs the mode determination. Here, the count value P05 at the timing T23 is greater than the second threshold Thp. Thus, the polarity application time counter 33 continuously operates the liquid crystal panel 10 in the second mode. The polarity application time counter 33 outputs the first instruction signal SW for instructing the liquid crystal panel 10 to operate in the second mode. Consequently, the liquid crystal panel 10 continues to operate in the second mode after the timing T23.

As described above, the liquid crystal panel 10 continues to operate in the second mode after the timing T23. Thus, the polarity application time counter 33 gradually decreases the count value. In FIG. 5, the count value is gradually decreased from the count value P05 at the timing T23 to a count value M12 at a timing T24. At the timing T24, the count value M12 is less than the first threshold Thm.

Because the timing T24 in the frame period FT22 is the "predetermined timing", the polarity application time counter 33 performs the mode determination. Here, the count value M12 at the timing T24 is less than the first threshold Thm. Thus, the polarity application time counter 33 operates the liquid crystal panel 10 in the first mode. The polarity application time counter 33 outputs the first instruction signal SW for instructing the liquid crystal panel 10 to operate in the first mode from the supply timing of the write row shift clock signal SCL after the timing T24. Consequently, the liquid crystal panel 10 is operated in the first mode after the timing T24. That is, the operation mode of the liquid crystal panel 10, which has been operated in the second mode from the timing T22 to the timing T24, is switched to the first mode at the timing T24.

As described above, the liquid crystal panel 10 is operated in the first mode after the timing T24. Thus, the polarity application time counter 33 gradually increases the count value. In FIG. 5, although the count value is gradually increased from the count value M12 at the timing T24 to a count value M13 at a timing T25, the count value M13 is still less than the first threshold Thm.

Because the timing T25 in the frame period FT21 is the "predetermined timing", the polarity application time counter 33 performs the mode determination. Here, the count value M13 at the timing T25 is less than the first threshold Thm. Thus, the polarity application time counter 33 continuously operates the liquid crystal panel 10 in the first mode. The polarity application time counter 33 outputs the first instruction signal SW for instructing the liquid crystal panel 10 to operate in the first mode. Consequently, the liquid crystal panel 10 continues to operate in the first mode after the timing T25.

As described above, the liquid crystal panel 10 continues to operate in the first mode after the timing T25. Thus, the polarity application time counter 33 gradually increases the count value. In FIG. 5, although the count value M13 is less than the first threshold Thm at the timing T25, the count value is gradually increased from the timing T25 to a timing T26 and becomes a count value P06 greater than the second threshold Thp.

Because the timing T26 in the frame period FT22 is the "predetermined timing", the polarity application time counter 33 performs the mode determination. Here, the count value P06 at the timing T26 is greater than the second threshold Thp. Thus, the polarity application time counter 33 operates the liquid crystal panel 10 in the second mode. The polarity application time counter 33 outputs the first instruction signal SW for instructing the liquid crystal panel 10 to operate in the second mode. Consequently, the liquid crystal panel 10 is operated in the second mode after the timing T26. That is, the operation mode of the liquid crystal panel 10, which has been operated in the first mode from the timing T25 to the timing T26, is switched to the second mode at the timing T26.

Hereinafter, although not illustrated, in the example illustrated in FIG. 5, the first mode and the second mode are switched at the "predetermined timing" in frame periods FT22 of a set of frame periods FT21 and frame periods FT22 that are alternately repeated.

As illustrated in FIG. 5, even if the time lengths of all frame periods are not uniform, and the frame periods having different time lengths that are set in advance are periodically repeated, it is possible to hamper the occurrence of an imbalance between the operation time in the first mode and the operation time in the second mode. Even if the frame periods are repeated so that their lengths are alternately switched between a relatively long period and a relatively short period, the first mode and the second mode can be switched periodically. When the first mode and the second mode are irregularly switched in such a repeating pattern of the frame periods, a flicker may be visually recognized due to a change in brightness of an image and the like. However, in the embodiment, it is possible to hamper the occurrence of such a flicker.

As described above, in the embodiment, the liquid crystal display device 1 includes the liquid crystal panel 10 provided with the sub-pixels SPix, the control circuit (timing controller 30) that controls the operation of the liquid crystal panel 10, and the counter (for example, the polarity application time counter 33) that increases and decreases the count value with the elapse of time. Each of the sub-pixels SPix includes the first electrode (for example, the pixel electrode 15) and the second electrode (for example, the common electrode COML). The liquid crystal panel 10 can be switched between the first mode and the second mode. In the first mode and the second mode, the number and the arrangement of pixels in which the potential of the second electrode is set to be higher than the potential of the first electrode are the same as the number and the arrangement of pixels in which the potential of the first electrode is set to be higher than the potential of the second electrode. For example, assuming that, in the first mode in the frame inversion driving method, all the sub-pixels SPix are set such that the "potential of the second electrode is higher than the potential of the first mode". In such a case, in the second mode, all the sub-pixels SPix are set such that the "potential of the first electrode is higher than the potential of the second electrode". The counter starts counting in accordance with the supply timing of the first vertical synchronization signal Vsync among the vertical synchronization signals Vsync supplied from outside multiple times. The counter gradually increases the count value during a period in which the liquid crystal panel 10 is operated in the first mode, and gradually decreases the count value during a period in which the liquid crystal panel 10 is operated in the second mode. The control circuit sets the determination timing in accordance with the supply timing of the latest vertical synchronization signal Vsync. When the count value at the determination timing is equal to or less than the first threshold Thm, the control circuit operates the liquid crystal panel 10 in the first mode. When the count value at the determination timing is equal to or greater than the second threshold Thp, the control circuit operates the liquid crystal panel 10 in the second mode.

In the embodiment, when the count value at the determination timing becomes equal to or greater than the second threshold Thp by gradually increasing the count value during a period in which the liquid crystal panel 10 is operated in the first mode, the second mode is applied to the liquid crystal panel 10. In the embodiment, when the count value at the determination timing becomes equal to or less than the first threshold Thm by gradually decreasing the count value during a period in which the liquid crystal panel 10 is operated in the second mode, the first mode is applied to the liquid crystal panel 10. Thus, in the embodiment, the first mode and the second mode are switched in accordance with the supply timing of the latest vertical synchronization signal Vsync, and it is possible to hamper either one of the first mode and the second mode from being continuously applied to the liquid crystal panel 10. Thus, in the embodiment, it is possible to more reliably hamper the occurrence of deterioration such as burn-in that would be caused when the application time of the current in one direction among the currents in two directions, which are generated by the potential of the first electrode (for example, the pixel electrode 15) and the potential of the second electrode (for example, the common electrode COML), applied to the liquid crystals becomes longer than the application time of the current in the other direction.

When the count value at the determination timing is a value between the first threshold Thm and the second threshold Thp, the control circuit (timing controller 30) operates the liquid crystal panel 10 in one of the first mode and the second mode that is different from the mode immediately preceding the determination timing. Consequently, the frequency of the switching between the first mode and the second mode can be further increased in accordance with the supply timing of the latest vertical synchronization signal Vsync, and it is possible to more reliably hamper the liquid crystal panel 10 from being continuously operated in one of the first mode and the second mode.

An initial value of the count value of the counter (for example, the polarity application time counter 33) before the counting is started is set to be equal to or less than the first threshold Thm or equal to or greater than the second threshold Thp. Consequently, it is possible to operate the liquid crystal panel 10 regularly in one of the first mode and the second mode set in advance, after the "predetermined timing" in the first frame period.

In the embodiment, the control device 110 supplies the image signal P and the vertical synchronization signal Vsync to the liquid crystal display device 1 three or more times. Here, the time length between the supply timings of two vertical synchronization signal Vsync that are successive in time is optional. Thus, the display system 300 including the control device 110 and the liquid crystal display device 1 may be a display system supporting the dynamic frame rate method. In such a display system 300, it is possible to more reliably suppress the occurrence of deterioration such as burn-in that would be caused when the application time of the current in one direction among the currents in two directions, which are generated by the potential of the first electrode (for example, the pixel electrode 15) and the potential of the second electrode (for example, the common electrode COML), applied to the liquid crystals becomes longer than the application time of the current in the other direction.

The inversion driving method that inverts the potential relation between the pixel electrode 15 and the common electrode COML is not limited to the frame inversion driving method described above. For example, any one of a line inversion method, a column inversion method, and a pixel inversion method may be employed. The line inversion method refers to a method in which currents generated by the potentials of the pixel electrodes 15 and the common electrodes COML of lines adjacent to each other are opposite in direction in one frame period. The column inversion method refers to a method in which currents generated by the potentials of the pixel electrodes 15 and the common electrodes COML of pixel columns adjacent to each other are opposite in direction in one frame period. The pixel column refers to sub-pixels SPix (or pixels Pix including sub-pixels SPix) arranged in the second direction Dy. The pixel inversion method refers to a method in which, in one frame period, currents generated by the potentials of the pixel electrodes 15 and the common electrodes COML of sub-pixels SPix (or pixels Pix) adjacent to each other in the first direction Dx are opposite in direction and currents generated by those of sub-pixels SPix (or pixels Pix) adjacent to each other in the second direction Dy are opposite in direction.

For example, in the line inversion method, when the relative relation of the potential of the pixel electrode 15 with respect to that of the common electrode COML in each of the lines that are arranged from one end side toward the other end side in the second direction Dy is indicated by "high" or "low", the relative relation is in the order of "high", "low", "high", "low", "high", . . . in one of the first mode and the second mode. On the other hand, the relative relation is in the order of "low", "high", "low", "high", "low", . . . in the other of the first mode and the second mode. Here, in the first mode and the second mode, the number of pixels and the arrangement of pixels in which the potential of the second electrode is set to be higher than the potential of the first electrode are the same as the number of pixels and the arrangement of pixels in which the potential of the first electrode is set to be higher than the potential of the second electrode. For example, it is assumed that, in the first mode in the line inversion method, the pixel rows in which the potential of the second electrode is set to be higher than the potential of the first electrode are the odd-numbered pixel rows from one end side in the second direction Dy, and the pixel rows in which the potential of the first electrode is set to be higher than the potential of the second electrode are the even-numbered pixel rows from the one end side. In this case, in the second mode in the line inversion method, the pixel rows in which the potential of the second electrode is set to be higher than the potential of the first electrode are the even-numbered pixel rows from the one end side in the second direction Dy, and the pixel rows in which the potential of the first electrode is set to be higher than the potential of the second electrode are the odd-numbered pixel rows from the one end side. In an example of the column inversion method, "lines that are arranged from one end side toward the other end side in the second direction Dy" in the example of the line inversion method, correspond to "pixel columns that are arranged from one end side toward the other end side in the first direction Dx". In an example of the pixel inversion method, "lines that are arranged from one end side toward the other end side in the second direction Dy" in the example of the line inversion method, correspond to "sub-pixels SPix (or pixels Pix) that are arranged from one end side toward the other end side in the first direction Dx and sub-pixels SPix (or pixels Pix) that are arranged from one end side toward the other end side in the second direction Dy".

In the implementation of an inversion driving method, when the potential of the common electrode COML is changed between the first mode and the second mode, the specific configuration of the common electrodes COML corresponds to the inversion driving method to be employed. For example, in the line inversion method, the common electrode COML is individually provided line by line. In the column inversion method, the common electrode COML is individually provided column by column. In the pixel inversion method, the common electrode COML is individually provided for each sub-pixel SPix (or pixel Pix).

The "predetermined timing" is not limited to the timing at which the second predetermined time DT passes from the supply of the vertical synchronization signal Vsync. The "predetermined timing" may be any timing that satisfies that the time length from the vertical synchronization signal Vsync in each frame period is constant, and that is within each frame period. For example, the "predetermined timing" may be the supply timing of the vertical synchronization signal Vsync, the timing at which the elapsed time DT1 passes from the supply of the vertical synchronization signal Vsync, or the timing at which the elapsed time DT1 and the elapsed time DT2 pass from the supply of the vertical synchronization signal Vsync. The mode is switched at the supply timing of the write row shift clock signal SCL that is input after the "predetermined timing".

The term "greater than" in the explanation of the count value described above may be replaced with "equal to or greater than". The term "less than" in the explanation of the count value described above may be replaced with "equal to or less than". When the replacement is made, the term "equal to or greater than the first threshold Thm and equal to or less than the second threshold Thp" is replaced with "greater than the first threshold Thm and less than the second threshold Thp". That is, "between the first threshold Thm and the second threshold Thp" may be "greater than the first threshold Thm and less than the second threshold Thp", or may be "equal to or greater than the first threshold Thm and equal to or less than the second threshold Thp". The first mode and the second mode are switched when the count value is "equal to or greater than the first threshold Thm and equal to or less than the second threshold Thp" or "greater than the first threshold Thm and less than the second threshold Thp". Hence, the first mode and the second mode are switched when a difference between the total time the display panel (liquid crystal panel 10) is operated in the first mode and the total time the display panel is operated in the second mode is within a predetermined time, during a period from the start of the first write of a pixel signal to the display panel to the timing ("predetermined timing") according to the predetermined vertical synchronization signal Vsync.

In the above description, the polarity application time counter 33 sets the content of the first instruction signal SW. However, the embodiment is not limited thereto. The polarity instruction signal determination circuit 34 may acquire a count value from the polarity application time counter 33 at the "predetermined timing" and make a determination of setting the content of the first instruction signal SW.

The count value is not limited to the examples illustrated in FIG. 4 and FIG. 5. For example, a first counter that counts time of the first mode and a second counter that counts the continuous time of the second mode may be provided separately. In such a case, the count value is a value indicating the magnitude relation and the difference between the "first counter value" and the "second counter value".

In the above description, the mode is switched using the first threshold Thm and the second threshold Thp. However, the embodiment is not limited thereto. For example, the first electrode and the second electrode (pixel electrode 15 and common electrode COML) may be driven in one mode of the first mode and the second mode after the supply of the predetermined vertical synchronization signal Vsync, wherein the total time the display panel (liquid crystal panel 10) has been operated in the one mode is shorter than the total time the display panel has been operated in the other mode, during a period from the start of the first write of a pixel signal to the display panel to the timing ("predetermined timing") according to the predetermined vertical synchronization signal Vsync. More specifically, referred to the predetermined count value (0), the liquid crystal panel 10 may operate in the first mode when the count value is less than the predetermined count value at the "predetermined timing" and operate in the second mode when the count value is greater than the predetermined count value at the "predetermined timing".

Among the functions of the polarity application time counter 33, the function of counting the operation time in the first mode and the function of counting the operation time in the second mode may be provided outside of the timing controller 30. In this case, the polarity application time counter 33 in the timing controller 30 makes a determination on the basis of the comparison between the operation time in the first mode and the operation time in the second mode or on the basis of a difference between the operation time in the first mode and the operation time in the second mode, and outputs the first instruction signal SW.

The line-by-line control described above may be the control in units of groups of lines. That is, a drive signal may be supplied to more than one scanning line GL at the same time, and the pixel signal Sig may be supplied to the sub-pixels SPix that share the more than one scanning line GL with one another.

It should be understood that other functions and effects obtained by the forms described in the present embodiment that are apparent from the present specification or can be appropriately conceived by those skilled in the art are naturally obtained by the present disclosure.

What is claimed is:

1. A liquid crystal display device comprising:

a liquid crystal panel provided with a plurality of pixels;

a control circuit configured to control an operation of the liquid crystal panel; and a counter configured to increase and decrease a count value with an elapse of time, wherein each of the pixels is provided with a first electrode and a second electrode, the liquid crystal panel is configured to be switched between a first mode and a second mode, the number of pixels and an arrangement of pixels in which a potential of the second electrode is set to be higher than a potential of the first electrode in the first mode are the same as the number of pixels and an arrangement of pixels in which the potential of the first electrode is set to be higher than the potential of the second electrode in the second mode, the counter starts counting in accordance with a supply timing of a first vertical synchronization signal among a plurality of vertical synchronization signals supplied from outside, gradually increases the count value while the liquid crystal panel is operated in the first mode, and gradually decreases the count value while the liquid crystal panel is operated in the second mode, wherein the plurality of vertical synchronization signals are provided consecutively in sequence as a dynamic frame rate, and the control circuit sets a determination timing in accordance with the supply timing of a latest vertical synchronization signal, operates the liquid crystal panel in the first mode when the count value at the determination timing is equal to or less than a first threshold, and operates the liquid crystal panel in the second mode when the count value at the determination timing is equal to or greater than a second threshold that is greater than the first threshold.

2. The liquid crystal display device according to claim 1, wherein, when the count value at the determination timing is a value between the first threshold and the second threshold, the control circuit operates the liquid crystal panel in one of the first mode and the second mode that is different from the mode immediately preceding the determination timing.

3. The liquid crystal display device according to claim 1, wherein an initial value of the count value of the counter before the counting is started is set to be equal to or less than the first threshold or equal to or greater than the second threshold.

4. A display system comprising:

the liquid crystal display device according to claim 1; and a control device configured to supply an image signal and a vertical synchronization signal to the liquid crystal display device three or more times, wherein a time length between supply timings of two vertical synchronization signals that are successive in time is not uniform.

5. A display panel comprising:

a first electrode;

a second electrode provided to face the first electrode; and a liquid crystal layer provided between the first electrode and the second electrode, wherein a plurality of vertical synchronization signals are provided consecutively in sequence as a dynamic frame rate, and the display panel is configured to start writing a pixel signal input from outside in accordance with a vertical synchronization signal in the sequence input from outside, in a plurality of display frame periods, operate in a first mode in which a potential of the first electrode is higher than a potential of the second electrode, and a second mode in which the potential of the second electrode is higher than the potential of the first electrode, and drive the first electrode and the second electrode after the supply of a predetermined vertical synchronization signal in the sequence, in one of the first mode and the second mode that has a shorter total time during a period from a start of a first write of a pixel signal to the display panel to a timing according to the predetermined vertical synchronization signal.

6. A display panel comprising:

a first electrode;

a second electrode provided to face the first electrode; and a liquid crystal layer provided between the first electrode and the second electrode, wherein a plurality of vertical synchronization signals are provided consecutively in sequence as a dynamic frame rate, and the display panel is configured to start writing a pixel signal input from outside in accordance with a vertical synchronization signal in the sequence input from outside, in a plurality of display frame periods, operate in a first mode in which a potential of the first electrode is higher than a potential of the second electrode, and a second mode in which the potential of the second electrode is higher than the potential of the first electrode, and switch modes when a difference between a total time of the first mode and a total time of the second mode is within a predetermined time, during a period from a start of a first write of a pixel signal to the display panel to a timing according to a predetermined vertical synchronization signal in the sequence.

* * * * *